US009124020B2

(12) United States Patent
Kameda et al.

(10) Patent No.: US 9,124,020 B2
(45) Date of Patent: Sep. 1, 2015

(54) JUMPER CONNECTOR

(75) Inventors: Takashi Kameda, Chiyoda-ku (JP); Ichirou Okui, Tanba (JP); Masao Okai, Tanba (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/350,405

(22) PCT Filed: Oct. 18, 2011

(86) PCT No.: PCT/JP2011/073957

§ 371 (c)(1),
(2), (4) Date: Apr. 8, 2014

(87) PCT Pub. No.: WO2013/057794

PCT Pub. Date: Apr. 25, 2013

(65) Prior Publication Data

US 2014/0273612 A1 Sep. 18, 2014

(51) Int. Cl.
*H01R 31/08* (2006.01)
*H01R 13/46* (2006.01)
(Continued)

(52) U.S. Cl.
CPC *H01R 13/46* (2013.01); *B61G 5/10* (2013.01); *H01R 13/6395* (2013.01)

(58) Field of Classification Search
CPC .... H01R 13/46; H01R 13/6395; H01R 31/06; H01R 31/08
USPC ..... 439/507
See application file for complete search history.

(56) References Cited

U.S. PATENT DOCUMENTS 5,366,388 A * 11/1994 Freeman et al. ..... 439/540.1
6,962,506 B1 * 11/2005 Krobusek ..... 439/502
7,267,058 B2 9/2007 Ohashi et al.
(Continued)

FOREIGN PATENT DOCUMENTS

DE 10 2005 052 994 A1 5/2007
JP 34-19672 Y2 12/1959
(Continued)

OTHER PUBLICATIONS

International Search Report (PCT/ISA/210) mailed on Jan. 17, 2012, by the Japanese Patent Office as the International Searching Authority for International Application No. PCT/JP2011/073957.
(Continued)

*Primary Examiner* — Jean F Duverne
(74) *Attorney, Agent, or Firm* — Buchanan Ingersoll & Rooney PC

(57) ABSTRACT

To include an outfitting cable, a jumper cable, a connection plug receiver that is attached to an end of the outfitting cable, a connection plug that is attached to an end of the jumper cable, a casing that is provided below a vehicle floor, and that has the connection plug receiver introduced from a surface opposite to the surface on the side of the space between the vehicles to connect to the connection plug, a water blocking frame that is detachably attached to the surface of the casing on the side of the space between the vehicles, and that is formed with an inclined surface that includes an introduction opening into which the connection plug is introduced obliquely from below, and a gripping unit that is attached to the inclined surface and that grips the jumper cable.

7 Claims, 5 Drawing Sheets

(51) Int. Cl.
*H01R 13/639* (2006.01)
*B61G 5/10* (2006.01)

(56) References Cited

U.S. PATENT DOCUMENTS

| | | | | |
|---|---|---|---|---|
| 7,521,817 | B2 * | 4/2009 | Gors | 307/10.1 |
| 7,641,500 | B2 * | 1/2010 | Stoner et al. | 439/357 |
| 8,708,735 | B2 * | 4/2014 | Aime et al. | 439/510 |
| 8,802,259 | B2 * | 8/2014 | Lee et al. | 429/90 |
| 2008/0297164 | A1 * | 12/2008 | Carpio et al. | 324/537 |
| 2010/0044333 | A1 | 2/2010 | Marvel et al. | |

FOREIGN PATENT DOCUMENTS

| | | | |
|---|---|---|---|
| JP | 39-3970 | Y2 | 2/1964 |
| JP | 55-36012 | | 3/1980 |
| JP | 60-174540 | A | 9/1985 |
| JP | 61-84622 | U | 6/1986 |
| JP | 6-37045 | U | 5/1994 |
| JP | 8-265939 | A | 10/1996 |
| JP | 10-233259 | A | 9/1998 |
| JP | 2002-231361 | A | 8/2002 |
| JP | 2003-331998 | A | 11/2003 |
| JP | 2004-34784 | A | 2/2004 |
| JP | 2004-67072 | A | 3/2004 |
| JP | 2005-142472 | A | 6/2005 |
| JP | 2006-232203 | A | 9/2006 |
| JP | 2009-500237 | A | 1/2009 |
| JP | 2012-79490 | A | 4/2012 |

OTHER PUBLICATIONS

Written Opinion (PCT/ISA/237) mailed on Jan. 17, 2012, by the Japanese Patent Office as the International Searching Authority for International Application No. PCT/JP2011/073957.

Notice of Reason for Rejection dated Jul. 24, 2013 for Application No. 2012-518651 issued Jul. 13, 2013 and English translation.

* cited by examiner

JUMPER CONNECTOR

FIELD

The present invention relates to a jumper connector that is arranged between railway vehicles.

BACKGROUND

In each vehicle of a train, an outfitting cable that is a through cable for transmitting command information related to control for ensuring the safety in train formation (for example, a brake command and a command for raising/lowering pantographs) is laid below each vehicle floor in a vehicle longitudinal direction (in a vehicle traveling direction). A jumper cable is connected to the outfitting cable laid below the vehicle. A connector (a connection plug) is provided at each end of the jumper line. A connector (a connection plug receiver) that is electrically connected to this connection plug is provided at the end of the outfitting cable.

The jumper cable is formed longer than a spacing between connecting surfaces of the vehicles so as to respond to movement of the vehicles that are running, and is bent toward the rail by its own weight. The jumper cable is required to have strength that can withstand breakage caused by flying stones or the like. The connection plug and the connection plug receiver are required to have sufficient strength for being pulled by the jumper cable and to have high waterproof performance for preventing entry of rainwater.

For example, a conventional technique described in Patent Literature 1 is configured to use a connection plug and a connection plug receiver that are waterproof to prevent entry of rainwater, and is also configured to provide a protective plate below a jumper cable to prevent breakage of the jumper cable caused by flying stones.

CITATION LIST

Patent Literature

Patent Literature 1: Japanese Utility Model Laid-open Publication No. H6-37045 (FIG. 1 and the like)

SUMMARY

Technical Problem

However, in the typical conventional technique in Patent Literature 1, a connection plug and a connection plug receiver are not only waterproof, but also are special in that they have high tensile strength because the weight of the jumper cable is applied to the connection plug. Therefore, there is a problem in that the conventional technique cannot meet the needs for using a general connection plug and a general connection plug receiver that are non-waterproof to reduce the cost of a jumper connector, while increasing its reliability.

The present invention has been achieved in order to solve the above-described problems, and an object of the present invention is to provide a jumper connector with an enhanced reliability.

Solution to Problem

The present invention is directed to a jumper connector that achieves the object. The jumper connector includes an in-vehicle wire cable that is wired in each of vehicles that constitute a train; a jumper cable that is wired between the vehicles adjacent to each other, and that connects the in-vehicle wire cables; a first connector that is attached to an end of the in-vehicle wire cable; a second connector that is attached to an end of the jumper cable; a first casing that is provided below a vehicle floor in a vicinity of a space between the vehicles, that is formed with an opening, into which the second connector is introduced, on a surface on a side of the space between the vehicles, and that has the first connector introduced from a surface opposite to the surface on the side of the space between the vehicles to connect to the second connector; a second casing that is detachably attached to a surface of the first casing on the side of the space between the vehicles, and that is formed with an inclined surface that includes an introduction opening into which the second connector is introduced obliquely from below a surface thereof on the side of the space between the vehicles; and a gripping unit that is attached to the inclined surface and that grips the jumper cable.

Advantageous Effects of Invention

According to the present invention, because the weight of a jumper line is not directly applied to a connection plug, and rainwater is prevented from adhering to the connection plug and a connection plug receiver, the reliability of a jumper connector can be enhanced.

DESCRIPTION OF EMBODIMENTS

Exemplary embodiments of a jumper connector according to the present invention will be explained below in detail with reference to the accompanying drawings. The present invention is not limited to the embodiments.

Embodiment

Figure 1:
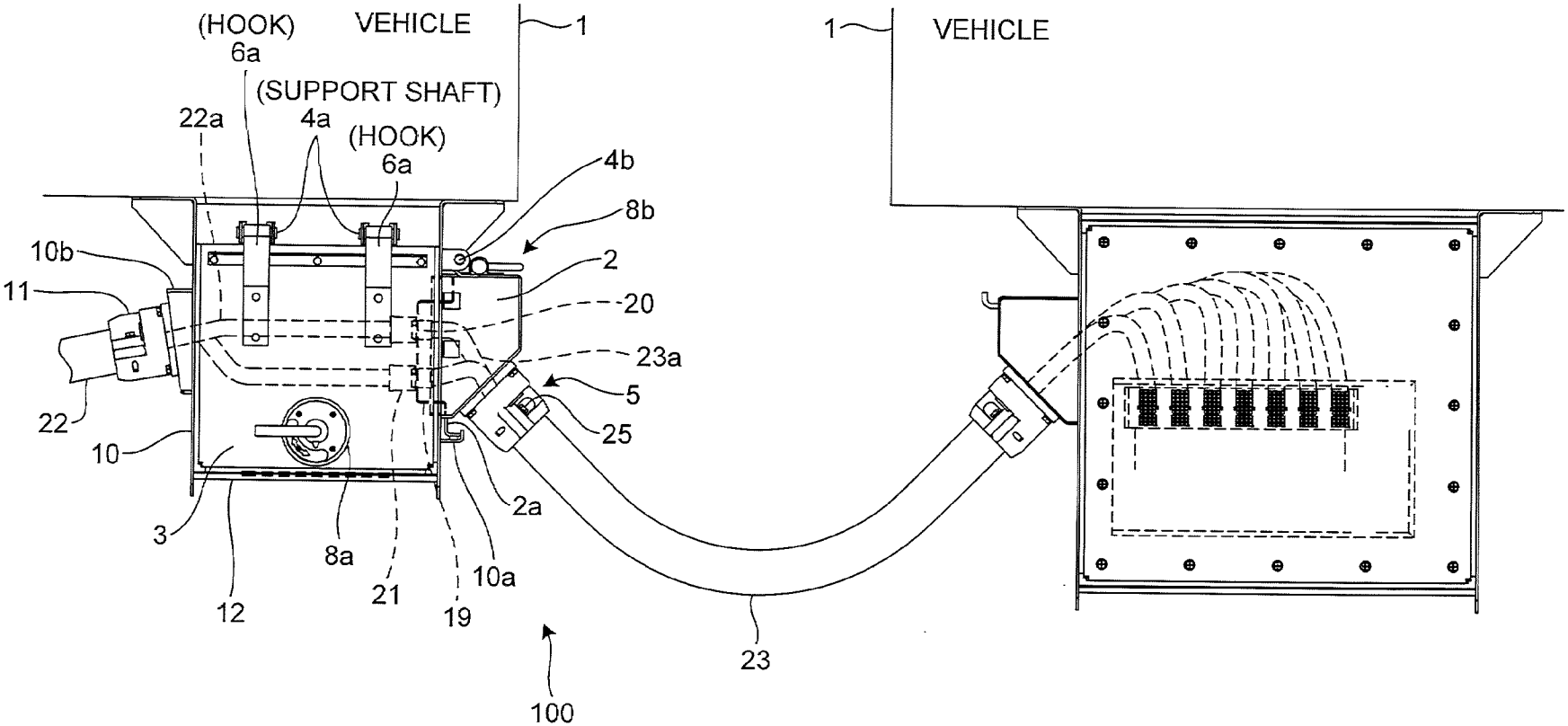
FIG. 1 schematically depicts a train to which a jumper connector according to an embodiment of the present invention is attached.
Figure 2:
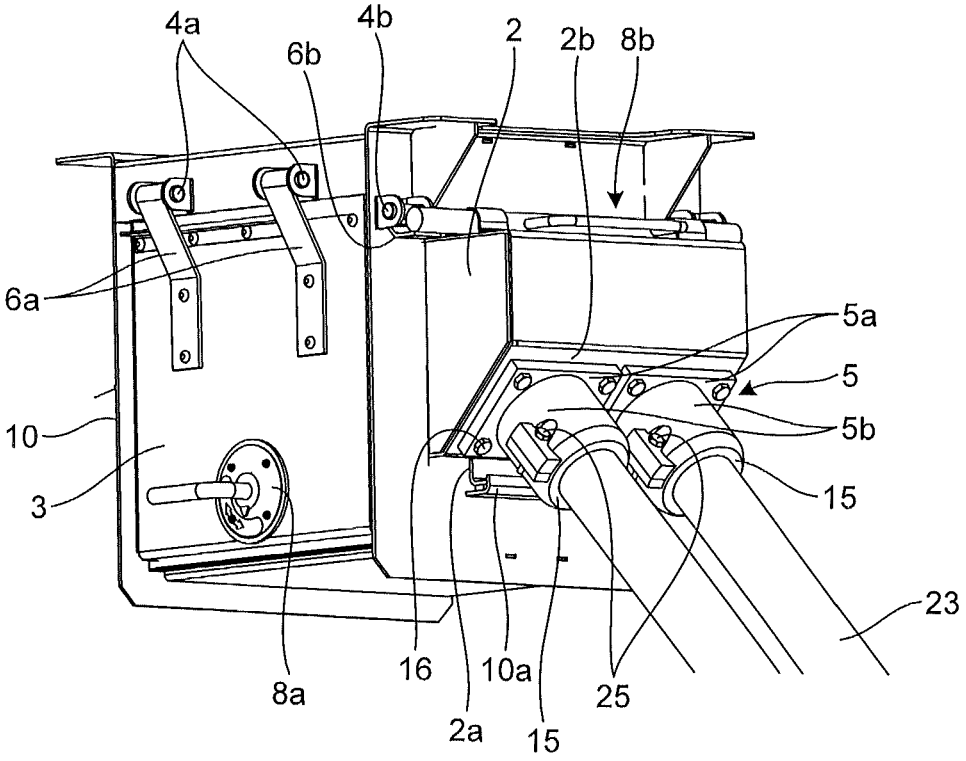
FIG. 2 is an external perspective view of a jumper connector.
Figure 3:
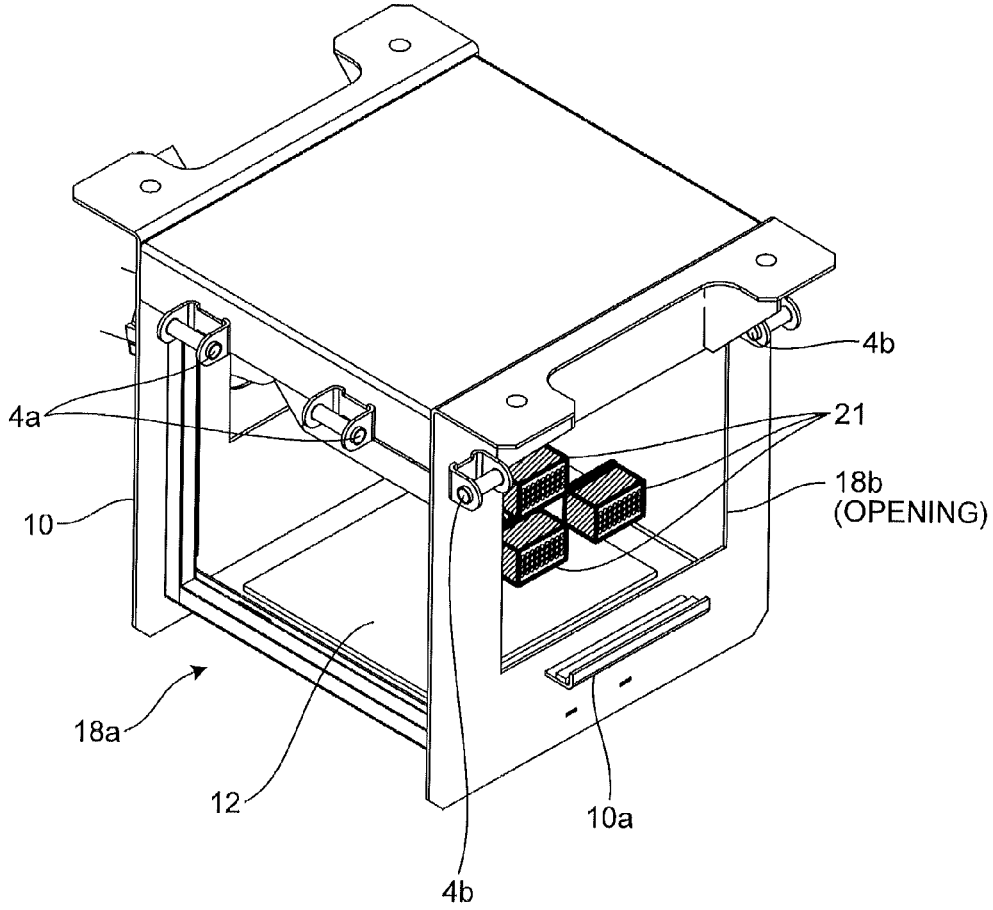
FIG. 3 is an external perspective view of a casing.
Figure 4:
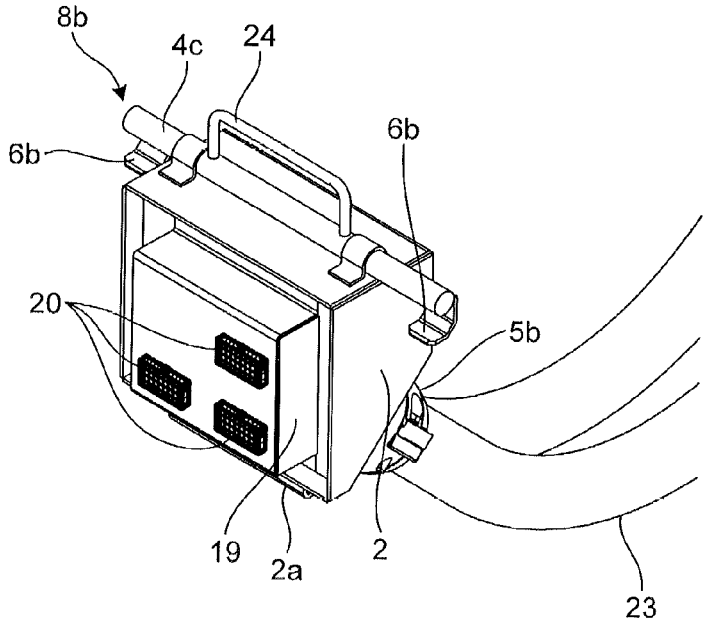
FIG. 4 is an external perspective view of a water blocking frame.
Figure 5:
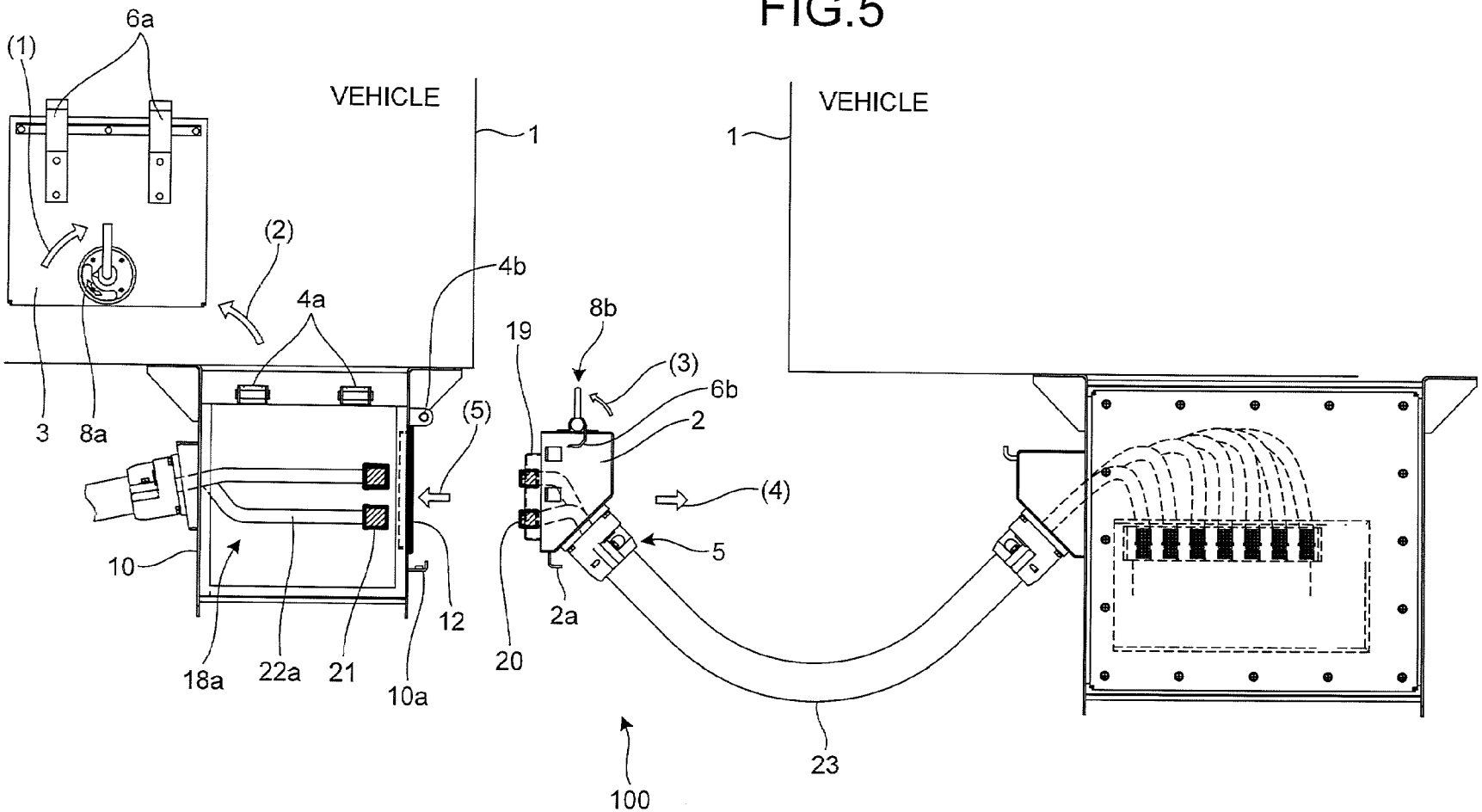
FIG. 5 is an explanatory diagram of an operation of removing a water blocking frame from a casing.

FIG. 1 schematically depicts a train to which a jumper connector 100 according to an embodiment of the present invention is attached. FIG. 2 is an external perspective view of the jumper connector 100, and depicts a casing 10 with a cover 3 and a water blocking frame 2 attached thereto. FIG. 3 is an external perspective view of the casing 10. FIG. 4 is an external perspective view of the water blocking frame 2. FIG. 5 is an explanatory diagram of an operation of removing a water blocking frame from a casing.

FIG. 1 depicts two vehicles 1 that constitute train formation as an example, and the jumper connector 100 that is provided at a position where the vehicles 1 are opposed to each other. A jumper cable 23 that is formed longer than a spacing between opposed surfaces of the vehicles 1 so as to respond to movement of the vehicles 1 that are running is laid between the vehicles 1 in a state of being bent toward the rail by its own weight.

An outfitting cable 22 is arranged in each of the vehicles 1. The outfitting cable 22 is a through cable for transmitting command information related to control for ensuring the safety in the train formation (for example, a brake command and a command for raising/lowering pantographs). A connection plug receiver 21 is attached to the end of a signal line 22*a* within the outfitting cable 22. A connection plug 20 that is attached to each end of a signal line 23*a* within the jumper cable 23 is connected to the connection plug receiver 21.

As described above, the outfitting cables 22 of the vehicles 1 are connected to each other through the jumper cable 23. Therefore, for example, when a command for raising/lowering pantographs is output from an operator-cab I/F unit (not shown) installed in the leading vehicle 1, a pantograph drive circuit (not shown) installed in each of the vehicles 1 receives the command for raising/lowering pantographs through the outfitting cable 22 and the jumper cable 23, and operates pantographs (not shown).

The connection plug receiver 21 and the connection plug 20 are general non-waterproof connectors. A plurality of pins (for example, jack pins) corresponding to the number of the signal lines 22*a* are provided in the connection plug receiver 21. A plurality of pins (for example, plug pins) corresponding to the number of the signal lines 23*a* are provided in the connection plug 20. In the following explanations, unless otherwise specified, the signal line 22*a* is read as the outfitting cable 22, and the signal line 23*a* is read as the jumper cable 23.

A configuration of the jumper connector 100 is specifically explained below. The jumper connector 100 shown in FIG. 1 includes, as its main constituent elements, the casing 10, the water blocking frame 2, and a gripping unit 5 that is attached to each end of the jumper cable 23.

The casing 10 is formed into a cuboid shape, and is attached below the floor of each of the vehicles 1 in a suspended manner between the outfitting cable 22 and the jumper cable 23. The water blocking frame 2 is provided on a surface of the casing 10 on the side of the jumper cable 23. The water blocking frame 2 has a volume smaller than that of the casing 10, and is formed into a cuboid shape. An outfitting-cable introduction portion 10*b* is provided on the surface of the casing 10 on the side of the outfitting cable 22 (that is, one of the side surfaces of the casing 10, which is opposite to the side surface to which the water blocking frame 2 is attached).

A gripping unit 11 is provided on the outfitting-cable introduction portion 10*b*. The gripping unit 11 has the same shape as the gripping unit 5 described later, and is arranged such that the distal end of the gripping unit 11 is angled obliquely downward relative to the horizontal direction. By providing the gripping unit 11 as described above, rainwater can be prevented from entering the casing 10 through a space between the casing 10 and the outfitting cable 22, and also the outfitting cable 22 can be fixed to the casing 10.

In FIG. 2, a lever 8*b* is provided on the top of the water blocking frame 2, and an engaging unit 2*a* that engages with a support unit 10*a* provided on the side surface of the casing 10 is provided at the bottom of the water blocking frame 2.

The engaging unit 2*a* extends horizontally and parallel to the side surface of the casing 10. The engaging unit 2*a* is used for attaching/detaching the water blocking frame 2 to/from the casing 10. For example, if the water blocking frame 2 can be temporarily placed on the support unit 10*a* when the water blocking frame 2 is attached to the casing 10, a rotating operation of the lever 8*b* is facilitated. Further, in a case where a waterproof rubber packing is provided between the side surface of the casing 10 and the water blocking frame 2, when the lever 8*b* is operated, the water blocking frame 2 is moved in a direction to press this rubber seal by using the engaging unit 2*a* as a pivot point. Therefore, rainwater can be prevented from entering the casing 10 through a space between the casing 10 and the water blocking frame 2.

An inclined surface 2*b* that is inclined toward the bottom of the casing 10, and that includes an introduction opening 2*c* (see FIG. 6 described later) of the jumper cable 23 is formed on the lower side of the surface of the water blocking frame 2 on the side of a space between the vehicles 1. The inclined surface 2*b* is inclined so as to be closer to the surface of the casing 10 on the side of the space between the vehicles 1, as it approaches toward the bottom of the casing 10. The gripping unit 5 that is constituted by a base portion 5*a* and a gripping member 5*b* is provided on the inclined surface 2*b*.

The base portion 5*a* is attached to the inclined surface 2*b* of the water blocking frame 2 by using a fastening member 16. By providing a waterproof rubber packing or the like between the base portion 5*a* and the inclined surface 2*b*, rainwater can be prevented from entering the casing 10 through a space between the base portion 5*a* and the inclined surface 2*b*.

The gripping member 5*b* has a cylindrical shape that extends in a direction normal to the base portion 5*a* (in a direction perpendicular to the inclined surface 2*b*). The gripping member 5*b* surrounds the outer peripheral surface of the jumper cable 23, and pushes the outer peripheral surface of the jumper cable 23 toward its axis-center by fastening a fastening member 25 attached to the outer peripheral surface of the gripping member 5*b* to grip and support the jumper cable 23. Because the base portion 5*a* is provided on the inclined surface 2*b*, the gripping member 5*b* is arranged such that its distal end is angled obliquely downward relative to the horizontal direction (for example, at an angle of −45° relative to the horizontal direction). That is, the gripping unit 5 is arranged such that its surface into which the jumper cable 23 is introduced is oriented obliquely downward relative to the horizontal direction. By providing the gripping unit 5 as described above, not only rainwater can be prevented from entering into the casing 10 through the space between the jumper cable 23 and the gripping member 5*b*, but also degradation of the jumper cable 23 is suppressed because the jumper cable 23 is less bent on its end side. Regarding the procedure for attaching the gripping unit 5, the base portion 5*a* and the gripping member 5*b* of the gripping unit 5 are fitted onto the jumper cable 23 before the jumper cable 23 is introduced into the water blocking frame 2, and thereafter the base portion 5*a* is attached to the inclined surface 2*b* by the fastening member 16, and the gripping member 5*b* is fastened by the fastening member 25.

Next, the cover 3 is explained. The cover 3 is provided on a side surface of the casing 10 other than the surfaces into which the jumper cable 23 and the outfitting cable 22 are respectively introduced (for example, on a surface on the side of the side surface of the vehicle 1). On the outer side of the cover 3, two hooks 6*a* that extend upward from the vicinity of the center of the cover 3 and parallel to each other are provided. The ends of the hooks 6*a* respectively engage with two support shafts 4*a* that are provided on the upper side surface of the casing 10. Therefore, the cover 3 is provided on the side surface of the casing 10 in a suspended manner.

When the cover 3 is removed from the casing 10, a lever 8*a* is rotated by a predetermined angle to disengage hooking between a latch (not shown) provided integrally with the lever 8*a* and the inner periphery of an opening 18*a* shown in FIG. 3. In contrast, when the cover 3 is attached to the casing 10, the lever 8*a* is rotated to the position shown in FIG. 2 so that the latch (not shown) hooks into the inner periphery of the opening 18*a*. In order to prevent entry of rainwater, the jumper connector 100 can have a configuration in which the periphery of the cover 3 is bent toward the casing 10, and a rubber packing (not shown) is provided along the periphery of the opening 18*a*. With this configuration, when the cover 3 is closed and the lever 8*a* is operated, the cover 3 is moved in a direction to press the rubber packing by using the support shafts 4*a* as pivot points. Therefore, rainwater can be prevented from entering the casing 10 through a space between the casing 10 and the cover 3.

In FIG. 3, an opening 18*b* is formed on the surface of the casing 10 into which the jumper cable 23 is introduced, and the opening 18*a* is formed on a side surface of the casing 10 other than the surfaces into which the jumper cable 23 and the outfitting cable 22 are respectively introduced. The opening 18*a* is formed into a size through which the connection plug receiver 21 can be attached to/detached from the connection plug 20. The opening 18*b* is formed into a size through which a connection-plug holding unit 19 shown in FIG. 4 is capable of being introduced into the casing 10.

A closing plate 12 is placed at the bottom of the interior of the casing 10. The closing plate 12 closes the opening 18*b* after the water blocking frame 2 is removed from the casing 10. The closing plate 12 is fixed to the interior of the casing 10 by using a fastening member or the like (not shown) during a train operation. However, when the water blocking frame 2 is removed, the closing plate 12 is attached to the side surface of the casing 10 so as to cover the opening 18*b*.

In FIG. 4, the connection-plug holding unit 19 that holds the connection plug 20 is provided on the surface of the water blocking frame 2 on the side of the casing 10. The connection-plug holding unit 19 is inserted from the opening 18*b* into the casing 10. A plurality of connection plugs 20 are attached to the end surface of the connection-plug holding unit 19 such that each distal end of the connection plugs 20 is oriented toward the center of the casing 10. For example, after the signal lines 23*a* are connected to a plurality of pins (not shown) provided in the connection plug 20, the connection plug 20 is fixed to the connection-plug holding unit 19 by using a fastening member or the like (not shown). By using the connection-plug holding unit 19, it is unnecessary for a worker to retain the connection plug 20 when the connection plug receiver 21 is attached to/detached from the connection plug 20. Therefore, the connection plug receiver 21 can be easily connected to the connection plug 20, and it is also possible to easily remove the connection plug receiver 21 from the connection plug 20.

The lever 8*b* shown in FIG. 4 is configured by including a support shaft 4*c* that has a bar shape extending horizontally and parallel to the side surface of the casing 10 and that is rotatably provided on the top of the water blocking frame 2, a handle 24 that is provided to be capable of rotating the support shaft 4*c*, and hooks 6*b* that are attached to both ends of the support shaft 4*c* and that respectively engage with two support shafts 4*b* provided on the upper side surface of the casing 10.

When the water blocking frame 2 is attached to the casing 10, by rotating the lever 8*b* such that the handle 24 is pointed toward the jumper cable 23, the hooks 6*b* hook respectively into the support shafts 4*b*. The hooks 6*b* hook respectively into the support shafts 4*b*, and accordingly, the water blocking frame 2 comes into close contact with the casing 10 by using the engaging unit 2*a* as a pivot point. In contrast, when the water blocking frame 2 is removed from the casing 10, the lever 8*b* is rotated such that the handle 24 is located on the upper side of the support shaft 4*c*, and consequently, the hooking between the hooks 6*b* and the support shafts 4*b* is disengaged.

With reference to FIG. 5, an operation of removing the cover 3 and the water blocking frame 2 is specifically explained. (1) First, as shown in FIG. 5, when the lever 8*a* is rotated and operated in the clockwise direction as viewed from the front of the cover 3, a latch (not shown) provided integrally with the lever 8*a* is disengaged. (2) After the cover 3 is removed, the closing plate 12 accommodated in the casing 10 is removed, and also the connection plug receiver 21 is removed from the connection plug 20. (3) Thereafter, as shown in FIG. 5, when the lever 8*b* is rotated and operated in a counterclockwise direction as viewed from the side of the water blocking frame 2, the hooking between the support shafts 4*b* and the hooks 6*b* is disengaged. (4) After the hooking between the support shafts 4*b* and the hooks 6*b* is disengaged, the water blocking frame 2 is removed from the casing 10. (5) Thereafter, the closing plate 12 is attached to the opening 18*b* of the casing 10, and the cover 3 is attached to the opening 18*a*. Closing the openings 18*a* and 18*b* can prevent rainwater from adhering to the connection plug receiver 21, for example when the vehicles 1, having been disconnected from each other, are carried to a depot.

Figure 6:
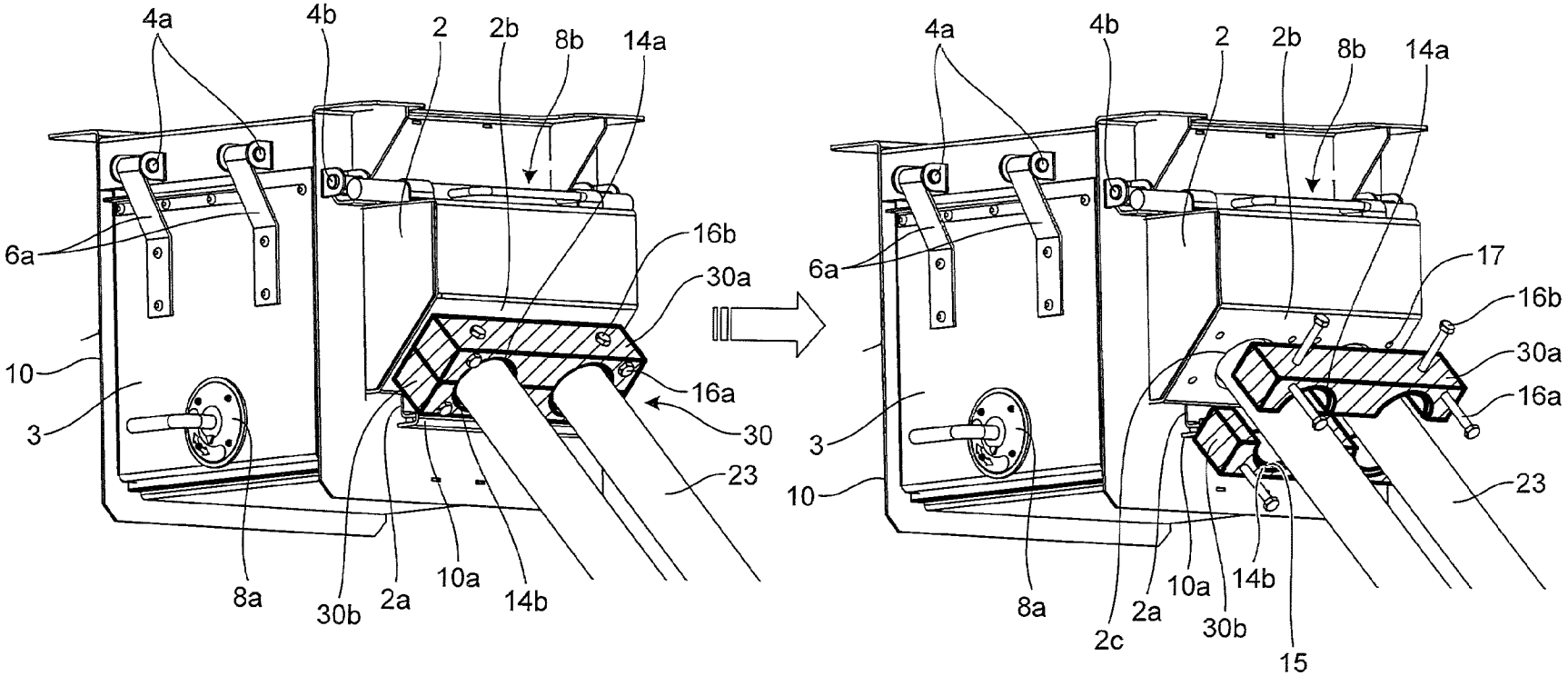
FIG. 6 depicts another configuration example of a gripping unit.

FIG. 6 depicts another configuration example of the gripping unit 5. The casing 10 and the water blocking frame 2, both shown in FIG. 6, are the same as those shown in FIG. 2. However, instead of the gripping unit 5 shown in FIGS. 1 to 5, a gripping unit 30 that is constituted by a first gripping member 30*a* and a second gripping member 30*b* is attached to the inclined surface 2*b* of the water blocking frame 2 shown in FIG. 6.

The first gripping member 30*a* is provided on the upper side of the jumper cable 23, extends in a horizontal direction, while extending orthogonally to the axial line of the jumper cable 23 that is introduced into the water blocking frame 2, and closes the upper side of the introduction opening 2*c*. In the first gripping member 30*a*, a curved and recessed engaging unit 14*a* that is formed with a radius of curvature larger than that of the cross section of the jumper cable 23, and that covers the upper side of the jumper cable 23 is formed.

The second gripping member 30*b* is provided on the lower side of the jumper cable 23, extends in the horizontal direction, while extending orthogonally to the axial line of the jumper cable 23 that is introduced into the water blocking frame 2, and closes the lower side of the introduction opening 2*c*. In the second gripping member 30*b*, a curved and recessed engaging unit 14*b* that is formed with a radius of curvature larger than that of the cross section of the jumper cable 23, and that covers the lower side of the jumper cable 23 is formed.

That is, the gripping unit 30 is arranged such that its surface into which the jumper cable 23 is introduced is oriented obliquely downward relative to the horizontal direction. The gripping unit 30 is attached to the inclined surface 2*b* by a fastening member 16*a* that is screwed from the surface of the gripping unit 30 on the side of the jumper cable 23 into an insertion hole 17 formed on the inclined surface 2*b*. The gripping unit 30 is attached from above and below the jumper cable 23 so as to sandwich the outer peripheral surface of the jumper cable 23 by a fastening member 16*b* that is screwed into a direction orthogonal to the extending direction of the jumper cable 23. Regarding the procedure for attaching the gripping unit 30, after the jumper cable 23 is introduced into the water blocking frame 2, the first gripping member 30*a* and the second gripping member 30*b* are fitted onto the jumper cable 23, and also are temporarily retained by the fastening member 16*b*. Thereafter, the first gripping member 30*a* and the second gripping member 30*b* are attached to the inclined surface 2*b* by the fastening member 16*a*, and then the fastening member 16*b* is fastened.

The jumper connector 100 according to the present embodiment can have a configuration in which an elastic member 15 is provided between the gripping member 5*b* shown in FIG. 2 and the jumper cable 23, or can also have a configuration in which the elastic member 15 is provided between the engaging units 14*a* and 14*b* shown in FIG. 6 and the jumper cable 23. Because vibrations of the vehicle 1, which act on the jumper cable 23, are reduced by providing the elastic member 15, degradation of the jumper cable 23 is suppressed. By providing the elastic member 15, even when the jumper cable 23 is deformed, a gap between the engaging units 14*a* and 14*b* and the jumper cable 23 is closed by the elastic member 15. Accordingly, it is also possible to prevent entry of rainwater through this gap into the opening 18*a*.

By providing a waterproof rubber packing or the like between the inclined surface 2*b* and the gripping unit 30, rainwater can be prevented from entering the casing 10 through a space between the inclined surface 2*b* and the gripping unit 30.

In FIG. 2, two gripping units 5 are attached to the water blocking frame 2 side by side in the horizontal direction. However, the number of the gripping units 5 is not limited to two, and can be one or can be three or more. Similarly, in FIG. 6, the gripping unit 30 is formed to be capable of gripping two jumper cables 23. However, the gripping unit 30 can be formed so as to grip one jumper cable 23 or three or more jumper cables 23. In the present embodiment, an example, in which the casing 10 and the water blocking frame 2 are provided on only one of the vehicles 1 shown on the left side in FIG. 1, has been explained. However, it is possible to provide the casing 10 and the water blocking frame 2 also to the other vehicle 1. In the present embodiment, the gripping unit 5 having a cylindrical shape or the gripping unit 30 having a cuboid shape, both of which are attached to the inclined surface 2*b* in a state of gripping the jumper 23, is used. However, the present invention is not limited to the gripping unit 5 or 30 as long as the gripping member can be attached to the inclined surface 2*b* in a state of gripping the jumper cable 23.

As explained above, the jumper connector 100 according to the embodiment of the present invention includes the outfitting cable 22 that is an in-vehicle wire cable that is wired in each vehicle, the jumper cable 23 that is wired between the vehicles adjacent to each other, and that connects the outfitting cables 22, the connection plug receiver 21 that is a first connector attached to the end of the outfitting cable 22, the connection plug 20 that is a second connector attached to the end of the jumper cable 23, a first casing (the casing 10) that is provided below the vehicle floor in the vicinity of a space between the vehicles, that is formed with the opening 18*b*, into which the connection plug 20 is introduced, on the surface on the side of the space between the vehicles, and that has the connection plug receiver 21 introduced from the surface opposite to the surface on the side of the space between the vehicles to connect to the connection plug 20, a second casing (the water blocking frame 2) that is detachably attached to the surface of the casing 10 on the side of the space between the vehicles, and that is formed with the inclined surface 2*b* that includes the introduction opening 2*c* into which the connection plug 20 is introduced obliquely from below the surface of the second casing on the side of the space between the vehicles, and the gripping unit 5 or 30 that is attached to the inclined surface 2*b* and that grips the jumper cable 23. Therefore, the weight of the jumper cable 23 is not directly applied to the connection plug 20, and entry of rainwater into the casing 10 is prevented. Accordingly, it is possible to transmit command information that is transmitted between the vehicles 1, without using a special connection plug 20 and a special connection plug receiver 21 that have high tensile strength and high waterproof performance. Because the connection plug receiver 21, the connection plug 20, the signal line 22*a*, and the signal line 23*a* are accommodated in the casing 10, it is also possible to reduce the possibility of these plugs and lines being broken by flying stones or the like. As a result, it is possible to enhance the reliability of the jumper connector 100 and also to reduce the cost of the jumper connector 100, by using a general connection plug 20 and a general connection plug receiver 21 that are non-waterproof. Particularly, this is more effective as the number of the jumper cables 23 is larger or as the number of the connection plugs 20 and the connection plug receivers 21 is larger.

The gripping unit 5 is configured by the base portion 5*a* that is attached to the inclined surface 2*b*, and the gripping member 5*b* that forms a cylindrical shape extending in a direction normal to the base portion 5*a*, and that pushes the outer peripheral surface of the jumper cable 23 toward its axis-center to grip the jumper cable 23. Therefore, rainwater can be prevented from entering into the casing 10 through a space between the jumper cable 23 and the gripping member 5*b*, and also the weight of the jumper cable 23 can be prevented from being directly applied to the connection plug 20.

Because the elastic member 15 is provided between the gripping member 5*b* and the jumper cable 23, vibrations of the jumper cable 23 are suppressed, and also a gap between the engaging units 14*a* and 14*b* and the jumper cable 23 is closed. As a result, it is possible to use the jumper cable 23 for a long period of time, and it is also possible to improve the waterproof performance.

The gripping unit 30 is configured by the first gripping member 30*a* and the second gripping member 30*a*. The first gripping member 30*a* forms a cuboid shape that extends horizontally and parallel to the inclined surface 2*b*, includes the curved and recessed engaging unit 14*a* that is formed with a radius of curvature larger than that of the cross section of the jumper cable 23, and is attached to the inclined surface 2*b* with the engaging unit 14*a* engaging with the upper side of the jumper cable 23. The second gripping member 30*a* has a cuboid shape that extends horizontally and parallel to the inclined surface 2*b*, includes the curved and recessed engaging unit 14*b* that is formed with a radius of curvature larger than that of the cross section of the jumper cable 23, and is attached to the inclined surface 2*b* with the engaging unit 14*b* engaging with the lower side of the jumper cable 23. Therefore, rainwater can be prevented from entering the casing 10 through a space between the jumper cable 23 and the gripping member 5*b*, and also the weight of the jumper cable 23 can be prevented from being directly applied to the connection plug 20. The gripping unit 30 is effective particularly in a case where a plurality of the jumper cables 23 is introduced into the water blocking frame 2.

Because the elastic member 15 is provided between the engaging units 14*a* and 14*b* and the jumper cable 23, vibrations of the jumper cable 23 are suppressed, and also a gap between the gripping member 5*b* and the jumper cable 23 is closed. As a result, it is possible to use the jumper cable 23 for a long period of time, and it is also possible to improve the waterproof performance.

The water blocking frame 2 includes the lever 8*b* that is constituted by the support shaft 4*c* that has a bar shape extending horizontally and parallel to the side surface of the casing 10 and that is rotatably provided on the top of the water blocking frame 2, the handle 24 that is provided on the support shaft 4*c*, and the hooks 6*b* that are attached to both ends of the support shaft 4*c* and that respectively engage with the support shafts 4*b* provided on the upper side surface of the casing 10. On the side surface of the casing 10 and below the surface on which the water blocking frame 2 is provided, the support unit 10*a* that extends horizontally to this surface is provided. At the bottom of the water blocking frame 2, the engaging unit 2*a* that engages the water blocking frame 2 with the support unit 10*a* is provided. Therefore, when the lever 8*b* is operated, the water blocking frame 2 is moved toward the casing 10 by using the engaging unit 2*a* as a pivot point so as to come into close contact with the casing 10. Accordingly, it is possible to improve the waterproof performance between the casing 10 and the water blocking frame 2.

The water blocking frame 2 is formed into a protruding shape to be inserted into the opening 18*b*, and includes a connector holding unit (the connection-plug holding unit) 19 that holds the connection plug 20 with the connection plug 20 oriented toward the surface of the water blocking frame 2 opposite to the surface on the side of a space between the vehicles. Therefore, the connection plug receiver 21 can be easily connected to the connection plug 20, and it is also possible to easily remove the connection plug receiver 21 from the connection plug 20.

The jumper connector according to the embodiment of the present invention is only an example of the contents of the present invention. The configuration can be combined with other well-known techniques, and it is needless to mention that the present invention can be configured while modifying it without departing from the scope of the invention, such as omitting a part the configuration.

INDUSTRIAL APPLICABILITY

As described above, the present invention is applicable to a jumper connector and is particularly useful for enhancing the reliability and reducing the cost.

REFERENCE SIGNS LIST

1 vehicle
2 water blocking frame (second casing)
2*a* engaging unit
2*b* inclined surface
2*c* introduction opening
3 cover
4*a*, 4*b*, 4*c* support shaft
5, 30, 11 gripping unit
5*a* base portion
5*b* gripping member
6*a*, 6*b* hook
8*a*, 8*b* lever
24 handle
10 casing (first casing)
10*a* support unit
10*b* outfitting-cable introduction portion
12 closing plate
14*a*, 14*b* engaging unit
15 elastic member
16, 16*a*, 16*b*, 25 fastening member
17 insertion hole
18*a*, 18*b* opening
19 connection-plug holding unit (connector holding unit)
20 connection plug (second connector)
21 connection plug receiver (first connector)
22 outfitting cable (in-vehicle wire cable)
22*a* signal line
23 jumper cable
23*a* signal line
30*a* first gripping member
30*b* second gripping member
100 jumper connector

The invention claimed is:

1. A jumper connector comprising:
an in-vehicle wire cable that is wired in each of vehicles that constitute a train;
a jumper cable that is wired between the vehicles adjacent to each other, and that connects the in-vehicle wire cables;
a first connector that is attached to an end of the in-vehicle wire cable;
a second connector that is attached to an end of the jumper cable;
a first casing that is provided below a vehicle floor in a vicinity of a space between the vehicles, that is formed with an opening, into which the second connector is introduced, on a surface on a side of the space between the vehicles, and that has the first connector introduced from a surface opposite to the surface on the side of the space between the vehicles to connect to the second connector;
a second casing that includes a rotary lever containing a handle, that is detachably attached to a surface of the first casing on the side of the space between the vehicles, and that is formed with an inclined surface that includes an introduction opening into which the second connector is introduced obliquely from below a surface thereof on the side of the space between the vehicles;
a gripping unit that is attached to the inclined surface and that grips the jumper cable; and
a fastening member that pushes the gripping unit toward an outer peripheral surface of the jumper line,
wherein the gripping unit is formed such that a diameter thereof on a surface opposed to the outer peripheral surface of the jumper cable at a time of fastening the fastening member is smaller than an outer diameter of the jumper cable, and
wherein the opening is closed by the second casing through an operation of the lever.

2. The jumper connector according to claim 1, wherein the gripping unit comprises:
a base portion that is attached to the inclined surface; and
a gripping member that forms a cylindrical shape extending in a direction normal to the base portion, and that pushes an outer peripheral surface of the jumper cable toward its axis-center by fastening the fastening member to grip the jumper cable.

3. The jumper connector according to claim 2, further comprising an elastic member provided between the gripping member and the jumper cable.

4. The jumper connector according to claim 1, wherein the gripping unit comprises:
a first gripping member that forms a cuboid shape extending horizontally and parallel to the inclined surface, that includes a curved and recessed engaging unit formed with a radius of curvature larger than a radius of curvature of a cross section of the jumper cable, and that is attached to the inclined surface with the engaging unit engaging with an upper side of the jumper cable, and
a second gripping member that forms a cuboid shape extending horizontally and parallel to the inclined surface, that includes a curved and recessed engaging unit formed with a radius of curvature larger than a radius of curvature of a cross section of the jumper cable, and that is attached to the inclined surface with the engaging unit engaging with a lower side of the jumper line, wherein the engaging units are pushed toward an outer peripheral surface of the jumper cable by fastening the fastening member.

5. The jumper connector according to claim 4, further comprising an elastic member provided between the engaging unit and the jumper cable.

6. The jumper connector according to claim 1, wherein the lever includes a support shaft that has a bar shape extending horizontally and parallel to a side surface of the first casing and that is rotatably provided on a top of the second casing, a handle that is provided on this support shaft, and hooks that are attached to both ends of the support shaft and that respectively engage with support shafts provided on an upper side surface of the first casing;

wherein the first casing includes a support unit, on the side surface thereof, below a surface to which the second casing is provided, that extends horizontally to the surface; and wherein the second casing includes an engaging unit, at a bottom thereof, that engages the second casing with the support unit.

7. The jumper connector according to claim 1, wherein the second casing includes a connector holding unit that is formed into a protruding shape to be inserted into the opening, and that holds the second connector with the second connector oriented toward a surface of the second casing opposite to the surface on the side of the space between the vehicles.

* * * * *